US006895956B2

(12) United States Patent
Fioriti et al.

(10) Patent No.: US 6,895,956 B2
(45) Date of Patent: May 24, 2005

(54) REMOTE CONTROL SYSTEM FOR MOTOR GROUPS FOR EXTRACTOR FANS, IN PARTICULAR FOR KITCHEN EXTRACTOR FANS

(75) Inventors: Stefano Fioriti, Sigillo (IT); Alex Cheimets, Arlington, MA (US)

(73) Assignee: Elica S.p.A., Fabriano - Ancona (IT)

( * ) Notice: Subject to any disclaimer, the term of this patent is extended or adjusted under 35 U.S.C. 154(b) by 0 days.

(21) Appl. No.: 10/618,842

(22) Filed: Jul. 14, 2003

(65) Prior Publication Data

US 2004/0079356 A1 Apr. 29, 2004

(30) Foreign Application Priority Data

Jul. 16, 2002 (IT) ..... MI2002A1568

(51) Int. Cl.[7] ..... F24C 15/20
(52) U.S. Cl. ..... 126/299 D; 126/301; 454/63
(58) Field of Search ..... 126/299 D, 299 R, 126/299 F, 301; 454/63, 65, 67; 55/DIG. 36

(56) References Cited

U.S. PATENT DOCUMENTS 3,585,920 A * 6/1971 Johnson ..... 126/299 D
4,084,947 A * 4/1978 Ear ..... 126/299 E
4,702,153 A * 10/1987 Grabow ..... 126/299 D
4,903,685 A * 2/1990 Melink ..... 126/299 D
5,027,790 A * 7/1991 Chern ..... 126/299 R
5,690,093 A * 11/1997 Schrank et al. ..... 126/299 D

FOREIGN PATENT DOCUMENTS

CH 678224 A5 * 8/1991 ..... F24C/15/20
JP 8-475 A * 1/1996 ..... F24C/15/20

* cited by examiner

*Primary Examiner*—Josiah C. Cocks
(74) *Attorney, Agent, or Firm*—Hedman & Costigan, P.C.

(57) ABSTRACT

A remote control system for motor groups (22) for extractor fans (21), in particular for industrial and kitchen extractor fans, according to which the motor group itself (22), provided dismounted from the extractor fan (21), can also be installed inside a protective casing (10), to be mounted at the outside of the building, separate and distant from the structure of the extractor fan (21); the electrical connection between extractor fan (21) and motorisation takes place through suitable multi-way connectors (17, 30), whereas the electrical connection of the extractor fan (21) to the mains is carried out inside a suitable connection block (27). In such a way, it is possible to connect different interchangeable motor groups (22) to a kitchen extractor fan (21), so as to offer the user the possibility of choosing the desired performance, without each time having to buy a new complete extractor fan (21).

7 Claims, 4 Drawing Sheets

REMOTE CONTROL SYSTEM FOR MOTOR GROUPS FOR EXTRACTOR FANS, IN PARTICULAR FOR KITCHEN EXTRACTOR FANS

The present invention refers to a remote control system for motor groups for extractor fans, in particular for industrial and kitchen extractor fans.

A conventional constructive type of kitchen extractor fans (which are usually installed above a cooking surface) foresees the use of one or more motorised fan groups, suitable for sucking in the fumes present in the air, which are normally mounted inside the extractor fan.

The fumes are thus collected inside a discharge pipe, the upper end of which is inserted in a flue of a building or communicates directly with the outside. The motorised fan groups collect the kitchen fumes and vapours, which are then conveyed inside the extractor fan casing and are sent towards the discharge pipe to then be expelled outside (directly or through a flue).

In some cases, however, the extractor fan motor groups must necessarily be installed outside of the building where the extractor fan is mounted, due to their excessive noisiness generated by the substantial suction capacity required.

Regarding which, many constructors offer the client a range of motors which divide into two groups, those which can be installed inside the extractor fan (having determined suction capacities) and those which can be installed outside of the building (with substantially higher suction capacities).

In any case, such a system is excessively rigid, since it forces the customer who finds the extractor fan too noisy to order a further motor group to be installed outside, with the consequence of a substantial worsening of the overall encumbrance and of the operating costs, due to the fact that a motorization (the one inside the extractor fan) must be kept unused or, worse, it has to be eliminated thus resulting in maintenance and disposal costs.

In some cases, moreover, since the extractor fan which is already functioning is not equipped for remote control of the motorisation, it is not even possible to foresee the solution of installing a new motor group outside of the building.

In the aforementioned requirements, the purpose of the present invention is, therefore, that of indicating a remote control system for motor groups for extractor fans, in particular for kitchen extractor fans, which allows complete interchangeability of the motorisations of such extractor fans, be they equipped for mounting in the structure of the extractor fan (with low and medium suction capacity) or for installation outside of the building (for suction groups with a high suction capacity and, therefore, somewhat noisy).

Another purpose of the present invention is that of realising a remote control system for motor groups for extractor fans, in particular for kitchen extractor fans, which allows high flexibility and efficiency of installation, as well as functionality and reliability for whatever application requirement, to be attained.

A further purpose of the invention is that of realising a remote control system for motor groups for extractor fans, in particular for kitchen extractor fans, which allows a fast mounting of the motorisations to be carried out, limiting the installation and operating costs for customers, with respect to conventional solutions.

These and other purposes, according to the present invention, are achieved by realising a remote control system for motor groups for extractor fans, in particular for kitchen extractor fans, according to claim 1, to which we refer for the sake of brevity. Further variant embodiments are described in the successive claims.

Advantageously, the remote control system according to the invention, together with the fast mounting of the motor groups, which are interchangeable, offers the user the possibility of simply and quickly mounting the motor group inside the extractor fan structure and, should the aforementioned motor group be considered to be too noisy, of removing it without negative consequence from the extractor fan casing and taking it to the outside of the building, in a sort of complete flexibility of implementation and of assembly, according to the user's needs and requirements.

To do this, the present invention proposes to realise a casing, to be installed at the outside of the building, where the motor group is to be housed and foresees the use of an interchangeable connection fitting, sized based upon the type of motor intended to be used, of a cover for protecting the casing, of a non-return valve for the discharge fumes and of an electric cable to be fitted inside the casing for containing the motor group so as to be able to carry out the control of the suction speed of the group.

The characteristics and advantages of a remote control system for motor groups for extractor fans, in particular for kitchen extractor fans, according to the present invention, shall become clearer from the following description, relative to an example non-limiting embodiment, referring to the attached schematic drawings, in which.

In normal applications, the motor group of each extractor fan, both of the industrial type and for kitchens, is secured inside the extractor fan with different attachment screws and is already mounted in the structure at the time of purchase.

In this case, however, the installation of the extractor fan requires substantial effort, due to the heavy weight to be supported.

Figure 2:
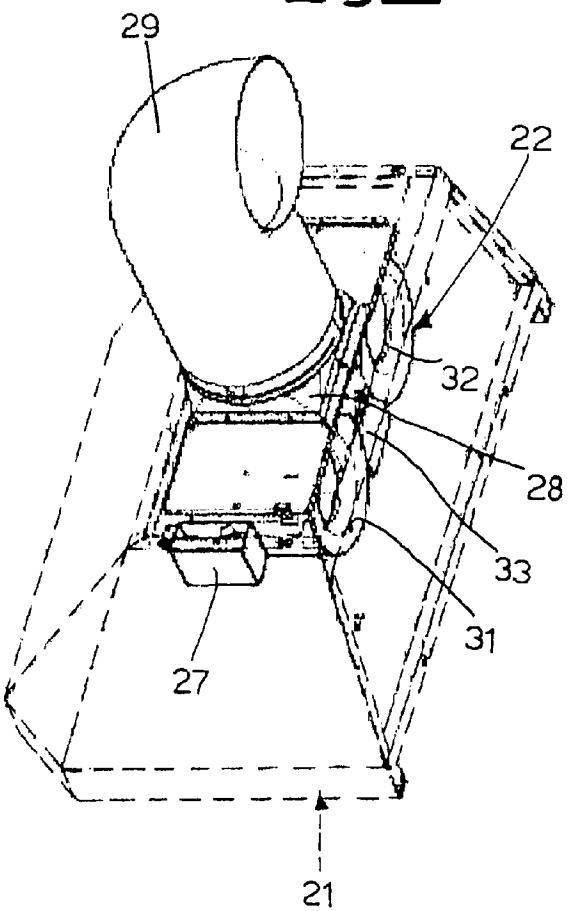
FIG. 2 is a perspective view of the kitchen extractor fan according to FIGS. 1A and 1B, in which the discharge pipe for the exhaust fumes and the steam in the air can also be seen.
Figure 1A:
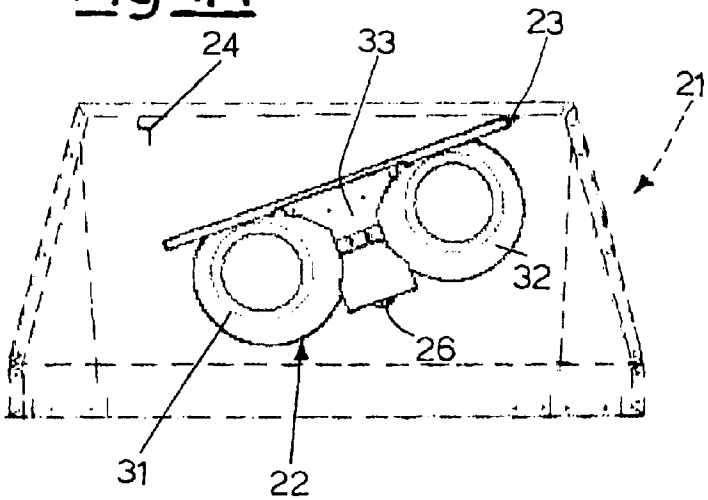
FIG. 1A is a schematic front view of a kitchen extractor fan equipped with a motor group inside, in which a first mounting step thereof can be seen.
Figure 1B:
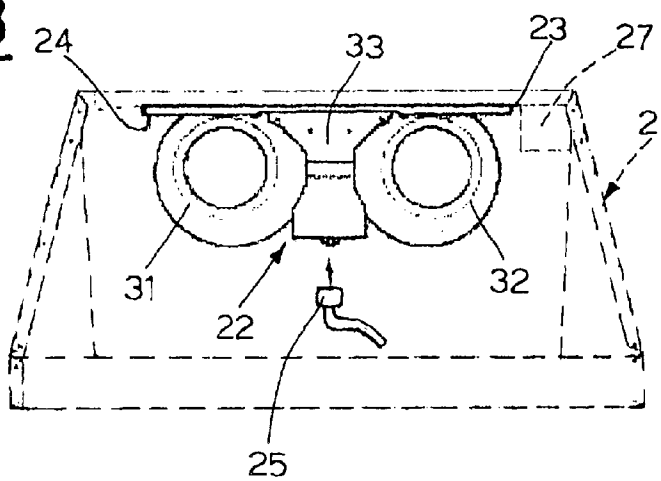
FIG. 1B is a schematic front view of the kitchen extractor fan according to FIG. 1A, in which a further mounting step of the motor group inside the structure.

In the solution illustrated in detail in FIGS. 1A, 1B and 2, on the other hand, the motor group, generically indicated with 22, is provided dismantled, so as to simplify the installation procedure, thanks to the fact that the structure of the extractor fan 21 can be mounted without having to support the additional weight of the motorisation.

With the extractor fan 21 installed and secured to the wall, the motor group 22 can be applied to the inside thereof in a fast, simple and secure manner, thanks to the use of a bracket 23, which guarantees its correct positioning, whereas a spring 24 locks it to prevent it from falling.

This gives the installer the possibility of definitively fixing the group with a security screw, without having to worry about supporting it with his hands.

The electrical connection takes place by means of suitable multi-way connectors, of which one (indicated with 26) is positioned on the motor group 22 and the other (indicated with 25) is arranged inside the extractor fan 21.

In such a way, it is possible to foresee the use of different interchangeable motor groups 22, in order to offer the user the possibility of choosing the appropriate performance (in electrical power), without having to buy a new extractor fan 21 already complete with motorisation.

The electrical connection of the extractor fan 21 to the mains is carried out inside a suitable connection box 27, whereas the fitting 28 and the duct 29 are foreseen to definitively convey air to the outside of the building 35.

Exploiting the configuration which has just been described, the extractor fan 21 is equipped for the remote control of an entire range of motorizations of different types and with different performances.

For example, should the user dislike the noise caused by the motor group 22, installed in the casing of the extractor fan 21 inside the building 35, he has the possibility of transferring the motorisation and installing the group 22 from inside the building to the outside, making use of a simple accessory for protecting the group, without being forced to buy a specific new group complete with a motor and, for this reason, having to eliminate the motor present inside the extractor fan 21.

Figure 3A:
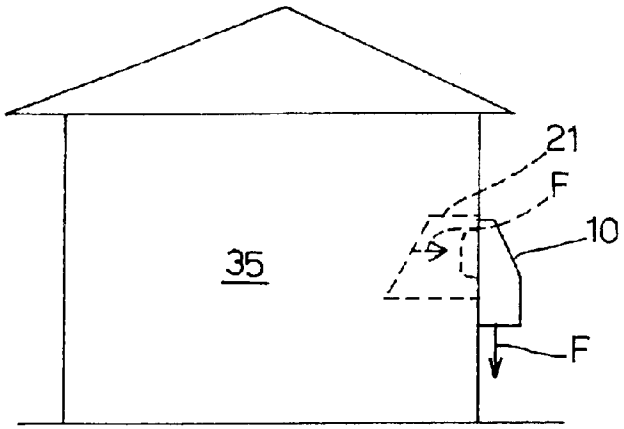
FIG. 3A shows a first schematic example of installation of a motor group outside of kitchen extractor fan.
Figure 3B:
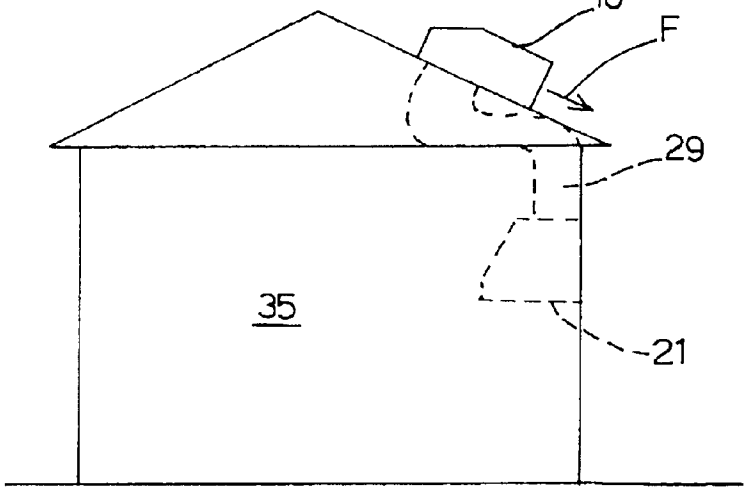
FIG. 3B shows an example of installation to the outside of the motor group which is alternative to the one illustrated in FIG. 3A.

Such new possible configurations are illustrated in detail in FIGS. 3A and 3B, which show two different arrangements (vertical and inclined mounting, respectively) of the outer casing 10 containing the motor group 22. The casing 10 is, in turn, connected to the structure of the extractor fan 21, which is mounted inside the building 35, through the duct 29.

FIGS. 3A and 3B also indicate, with arrows F, the outlet directions of the fumes and steams created inside the building 35.

Figure 4:
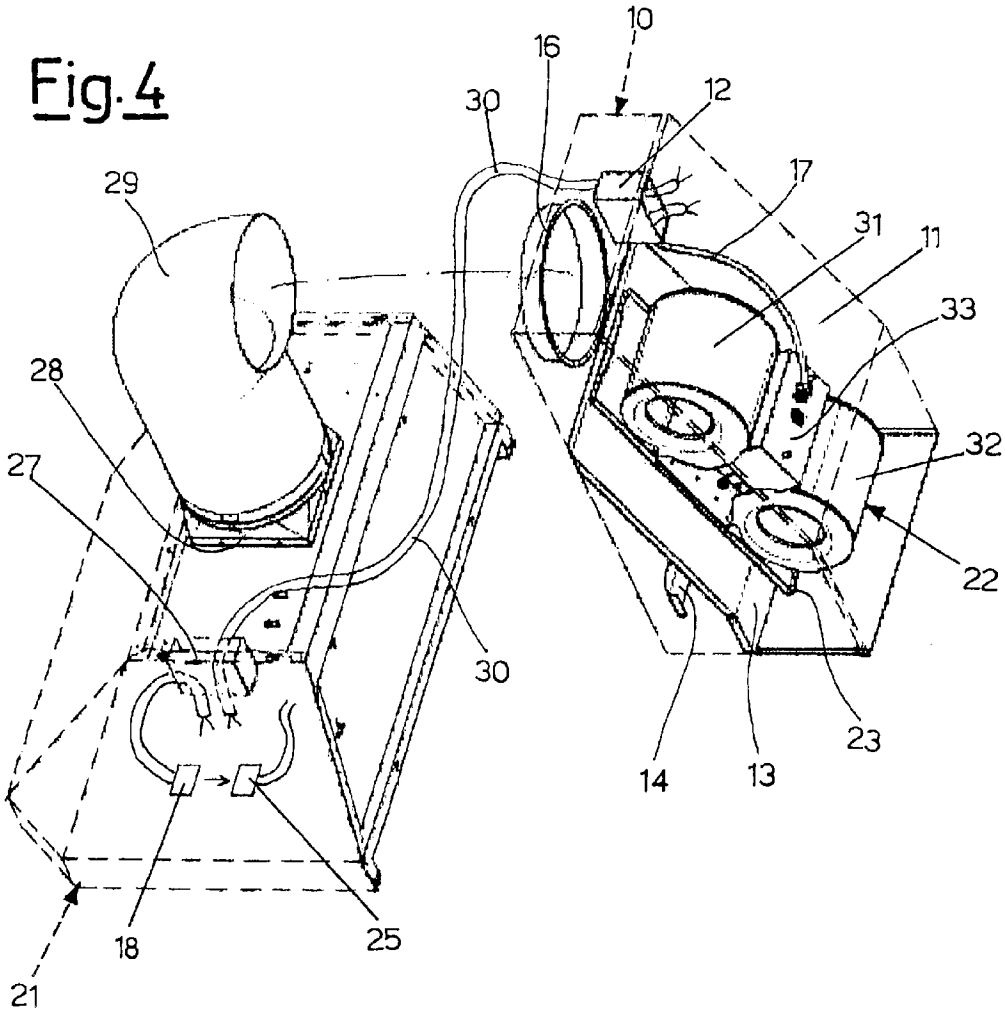
FIG. 4 shows a schematic perspective view of a remote control system for motor groups for extractor fans, in particular for kitchen extractor fans, according to the present invention.

In particular (see FIG. 4), the casing 10 essentially consists of a metal body and a cover 11 for the installation and maintenance of the motor group 22, and has internally an electrical connection box 12, a support 13 of the motor group 22, a deflector 14, a valve 15, a fitting 16 for the inlet of air and two cabling apparatuses equipped with suitable electric connectors (generically indicated with 17 and 18).

Then, once the motor group 22 has been dismounted from the inside of the extractor fan 21, it is possible to install the casing 10 to the outside of the building 35 in the desired position, taking care to take the outlet of the duct 29 in correspondence with the fitting 16.

It is thus possible to install the motor group 22 (for all of the ranges of types and performances foreseen), which has previously been dismounted from the extractor fan 21, inside the casing 10, carrying out the mounting on the support 13, as foreseen inside the wall of the extractor fan 21 and as described previously.

Once the motor group 22 has been installed in the casing 10, the connector 18 is connected to the power socket 25 and the connector block 27 is electrically connected to the box 12, by means of the conductor 30. The electrical connection box 12 thus feeds the motor group 22 by means of the conductor 17, which engages in the power socket 26 for the motorisation.

Figure 5B:
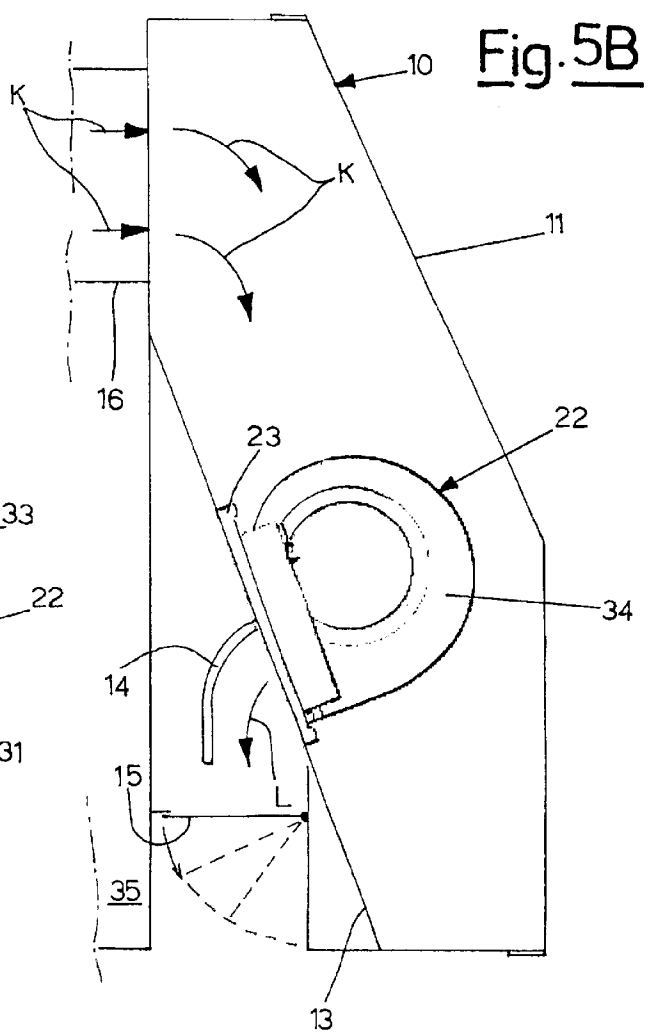
FIG. 5B is an enlarged detailed side view of a second example embodiment of one of the components of the remote control system according to FIG. 5A, according to the present invention.
Figure 5A:
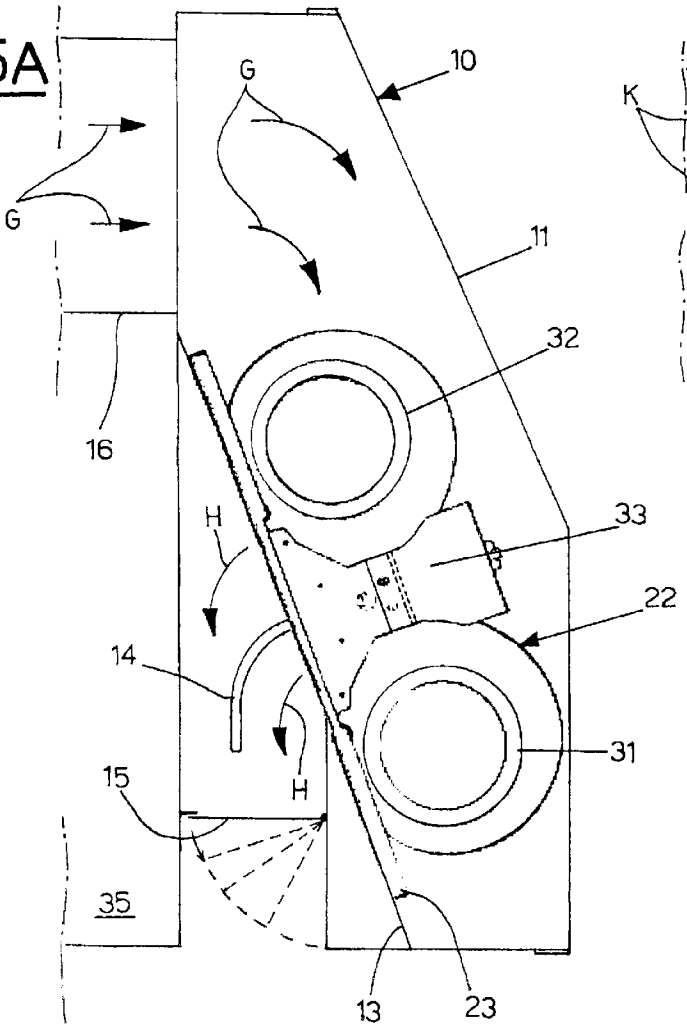
FIG. 5A is an enlarged detailed side view of a first example embodiment of one of the components of the remote control system according to FIG. 4, according to the present invention.

FIGS. 5A and 5B show two example embodiments of the casing 10, inside of which the mounting of respective high and medium power motor groups 22 is foreseen. In the case of FIG. 5A use is made of a ten-inch fitting 16 for the entry of fumes (directions G) and a motor group 22, mounted on the support 13 and made up of two motorised fans 31, 32 (already illustrated in FIGS. 1A, 1B, 2 and 4), which use the same delivery duct, mounted back-to-back and assembled by means of an intermediate support 33, so that the two outlet mouths are incident to each other, in order to suitably direct the exhaust fumes and steams to the outside (directions H), on opposite sides with respect to the deflector 14 and towards the valve 15.

On the other hand, FIG. 5B shows a casing 10, on which an eight-inch fitting 16 for the inlet of fumes along directions K is mounted, containing a medium power motorised fan group 34, mounted on the support 13 and suitable for expelling fumes and steam to the outside, in correspondence with the deflector 14, along direction L, and towards the valve 15.

From the description which has been made the characteristics of the remote control system for motor groups for extractor fans, in particular for kitchen extractor fans, object of the present invention are clear, just as the advantages are also clear.

Finally, it is clear that numerous variants can be brought to the remote control system in question, without for this reason departing from the novelty principles inherent to the inventive idea, just as it is clear that, in the practical embodiment of the invention, the materials, the shapes and the sizes of the illustrated details can be whatever according to the requirements and they can be replaced with others which are technically equivalent.

What is claimed is:

1. Remote control system for motor groups (22) for extractor fans (21), in particular for industrial and kitchen extractor fans, comprising a motor fan group (22) that is adapted to be dismounted from an extractor fan (21), said extractor fan having a power socket (25) connected to a multi-way connector (26) positioned on said motor fan group (22) which controls the suction speed of said motor group, said motor fan group (22) that is adapted to be installed inside at least one protective casing (10) separate and distant from said extractor fan (21) structure which further comprises a first connector block (27) having a connector (18) into which said power socket (25) is connected when said motor group (22) is installed inside said protective casing (10), and said motor fan group (22) being remotely electrically connected to said extractor fan (21), for the control of the suction speed of said motor fan group (22) when installed inside said protective casing (10), by means of suitable multi-way connectors (17, 30) to said extractor fan (21) through said first connector block (27), so as to connect various inter changeable motor fan groups (22) to the extractor fan (21).

2. Remote control system according to claim 1, wherein said protective casing (10) is installed at the outside of a building or house (35) and comprises at least one interchangeable fitting (16), its size to be based upon a type of said motor fan group (22), for use in connection to a delivery duct (29) of said extractor fan (21), and at least one protective cover (11) for said protective casing (10) and at least one non-return valve (15) for the discharge fumes.

3. Remote control system according to claim 1, wherein said protective casing (10) for said motor fan group (22) is made from metal and has at least one deflector element (14) in outlet.

4. Remote control system according to claim 1, wherein said motor fan group (22) when installed inside said protective casing (10) is fixed, inside said protective casing (10), on a suitable support (13).

5. Remote control system according to claim 1, wherein said protective casing (10) further comprising a second connection block (12) that feeds said motor fan group (22) when installed inside said protective casing (10), by means of said suitable multi-way conductor (17), which engages inside said multi-way connector (26) in said motor fan group (22) and said second connection block (12).

6. Remote control system according to claim 2, wherein said protective casing (10) includes high, medium and low suction power motor fan groups (22).

7. Remote control system according to claim 6, wherein said motor fan group (22) consists of at least one motorized fan (31, 32, 34), suitable for suitably directing the exhaust fumes and steam to the outside (H, L) towards valve (15).

* * * * *